US006340038B1

(12) United States Patent
Ingram

(10) Patent No.: US 6,340,038 B1
(45) Date of Patent: Jan. 22, 2002

(54) VERSATILE POURING SYSTEM INCLUDING A FUNNEL AND SPOUTS

(75) Inventor: Vicki Ingram, Emporia, KS (US)

(73) Assignee: Hopkins Manufacturing Corporation, Emporia, KS (US)

( * ) Notice: Subject to any disclaimer, the term of this patent is extended or adjusted under 35 U.S.C. 154(b) by 0 days.

(21) Appl. No.: 09/837,089

(22) Filed: Apr. 18, 2001

(51) Int. Cl.[7] ..... B65B 39/00; B67C 11/04

(52) U.S. Cl. ..... 141/333; 141/337; 222/566; 222/568

(58) Field of Search ..... 141/331, 333, 141/337, 339; 222/566–568

(56) References Cited

U.S. PATENT DOCUMENTS 3,986,538 A 10/1976 Sather
4,143,690 A 3/1979 Dunicz
4,351,454 A 9/1982 Maynard, Jr.
4,426,027 A 1/1984 Maynard, Jr.
4,583,668 A 4/1986 Maynard, Jr.
4,600,125 A 7/1986 Maynard, Jr.
5,020,702 A * 6/1991 James ..... 222/529

* cited by examiner

*Primary Examiner*—Timothy L. Maust
(74) *Attorney, Agent, or Firm*—Hovey, Williams, Timmons & Collins

(57) ABSTRACT

A versatile pouring system (10) reducible to constituent components having independent and combinatorial functionality. The pouring system (10) comprises a funnel (12), including a removable filter (26); a first spout (14); a second spout (16); and a cap (18). The funnel (12) is semi-rectangular with an offset neck (24) to securely receive and support common one quart fluid containers. The removable filter (26) is operatively positioned within the funnel neck (24) to trap and retain residue or debris. The spouts (14, 16) are of different lengths and are coupleable with the funnel (12), with one another, or with common wide or small-mouthed fluid containers. The cap (18) fits both spouts (14, 16). All four constituent components can be assembled into a single coherent unit for convenient storage.

9 Claims, 4 Drawing Sheets

VERSATILE POURING SYSTEM INCLUDING A FUNNEL AND SPOUTS

BACKGROUND OF THE INVENTION

1. Field of the Invention

The present invention relates to funnels and pouring spouts. More particularly, the invention relates to a versatile pouring system providing a wide variety of funnel and spout configurations and functions while unifying into an aggregate whole for convenient storage.

2. Description of the Prior Art

It is often desirable, particularly by professional and amateur mechanics, to have available a selection of funnels and pouring spouts so that the most suitable pouring means may be used for a particular job. It is further desirable, in order to facilitate storage and transportation, that these funnels and pouring spouts be combinable into as unified a package as may be possible and practical. For example, purchasing an assortment of independent funnels and spouts of various sizes and shapes is an undesirable solution due to difficulty in storing the funnels and spouts in such a manner as to prevent individual funnels and spouts from being misplaced from the set.

Combination devices, including one or more funnels and spouts, are known. Unfortunately, these prior art devices are typically narrowly adapted to particular containers or applications. For example, an existing combination device has a funnel component with a round mouth and centered neck unsuited to securely receiving and supporting rectangular fluid containers, such as oil containers. The same funnel has an integral cutting blade located near the bottom of the funnel for piercing fluid containers. Such a blade arrangement poses undesirable injury hazards, particularly when cleaning the funnel after use, and presents an obstruction on the funnel's interior surface which can impede fluid flow and drainage. Furthermore, existing combination devices are typically not as versatile as may be desired with regard to the independent functionality of each component and the number of possible useful sub-combinations.

An additional drawback of many existing devices is the lack of a cap for preventing undesirable loss of fluid or residue remaining in the funnel or spout. Where a cap is included, a means of retaining the cap typically is not, and so the cap is often misplaced of lost. Where a retaining mechanism is included, the cap is typically not held in an upright orientation, such that any fluid or residue remaining in the cap undesirably drips out.

Due to the above-identified and other problems in the art, a need exists for a pouring system having improved versatility and user safety.

SUMMARY OF THE INVENTION

The pouring system of the present invention overcomes the above-identified and other problems in the art to provide a simple and inexpensive combination device reducible to constituent components having increased functionality whether used independently, in sub-combinations, or as an aggregate whole.

The preferred pouring system comprises a funnel, including a removable filter; a short spout; a long spout; and a cap. The funnel is conveniently adapted with a rectangular mount and offset neck to securely receive and support common one quart fluid containers. No blades or other cutting elements are included that might pose safety risks, and a smooth interior surface improves flow and drainage and facilitates after-use cleaning. The funnel includes a handle incorporating a convenient cap holder operable to retain the cap in an upright position so that any fluid or residue within the cap remains therein. The removable filter is operably positioned in the funnel neck to trap and prevent residue or debris from being undesirably introduced into machinery or equipment to which fluid is being added.

The short spout may be coupled with a threaded portion of the funnel neck, or removable therefrom for independent use. The short spout is threaded and sized so as to fit commonly available large-mouthed fluid containers, such as one gallon antifreeze jugs, windshield washer fluid jugs, or emergency fuel containers.

The long spout may be threadably coupled to the short spout and, in turn, to the funnel neck, or removable therefrom for independent use. The long spout is doubly threaded so as to accommodate both large-mouthed containers, such as those described above, and small-mouthed containers, such as one quart oil or transmission fluid containers. The cap fits both the short and long spouts. All four constituent components can be assembled into a single coherent unit for convenient storage and transportation.

These and other important aspects of the present invention are more fully described in the section entitled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
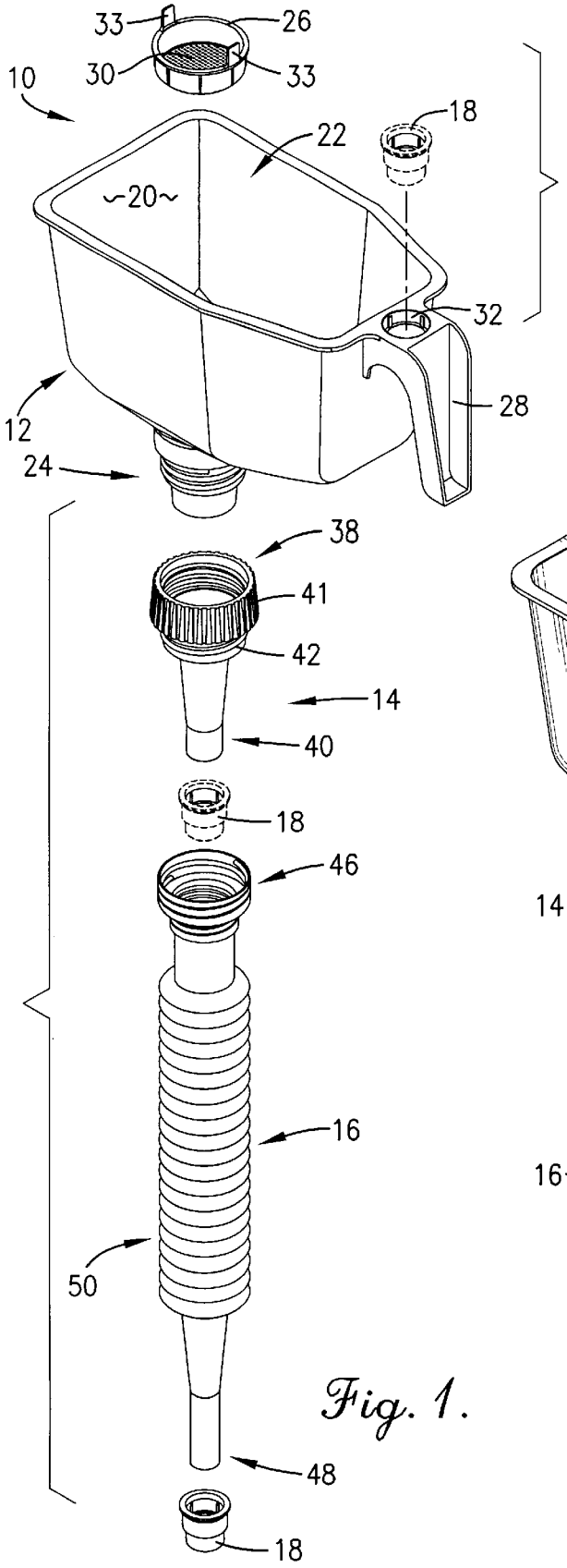
FIG. 1 is an exploded view of a preferred embodiment of the pouring system of the present invention, with alternative cap placements shown in broken line to facilitate understanding.
Figure 2:
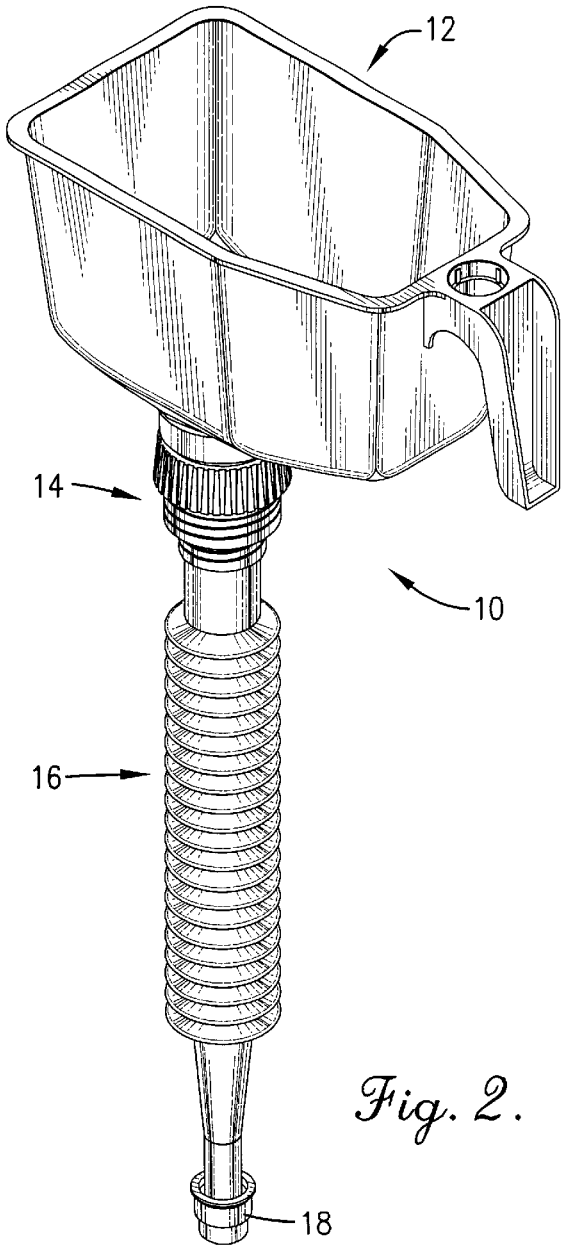
FIG. 2 is an isometric view of the assembled pouring system.
Figure 3:
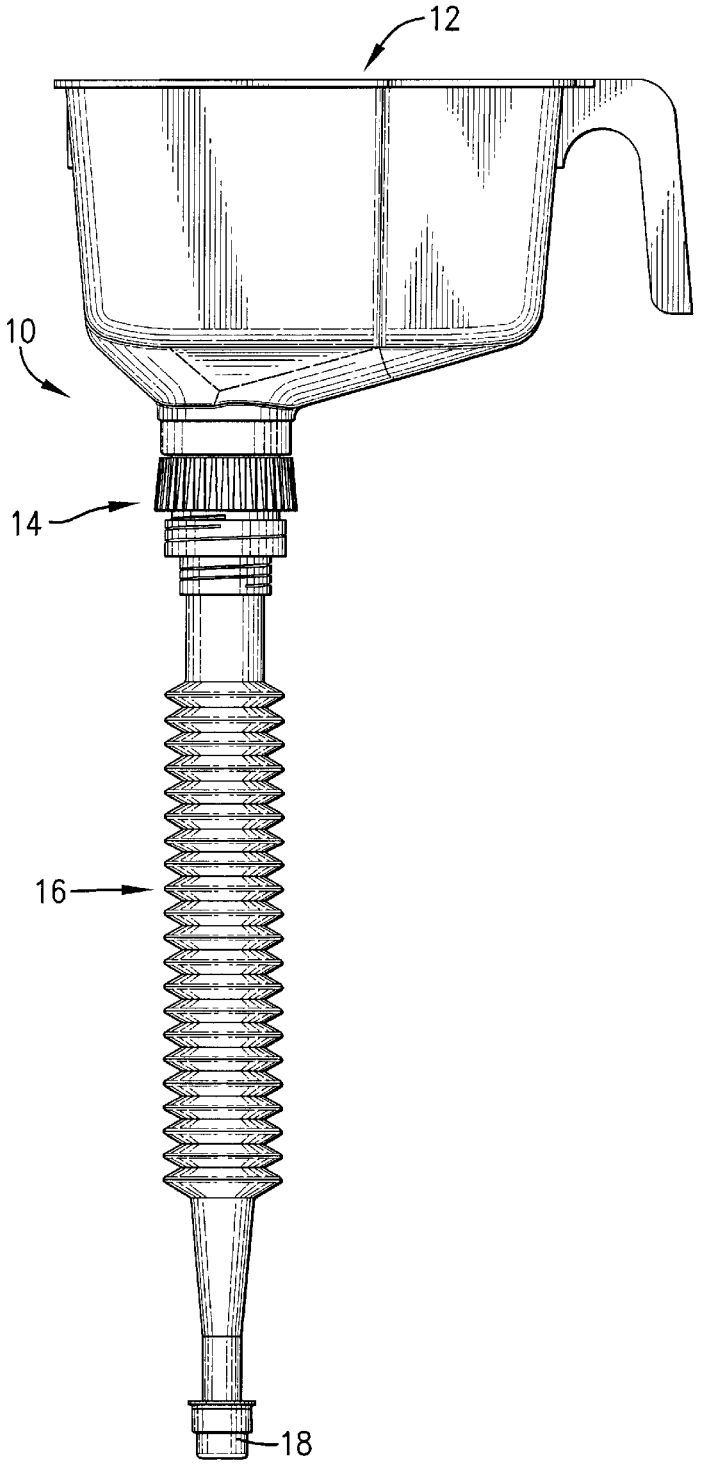
FIG. 3 is a right side elevational view of a preferred embodiment of the pouring system of the present invention.
Figure 4:
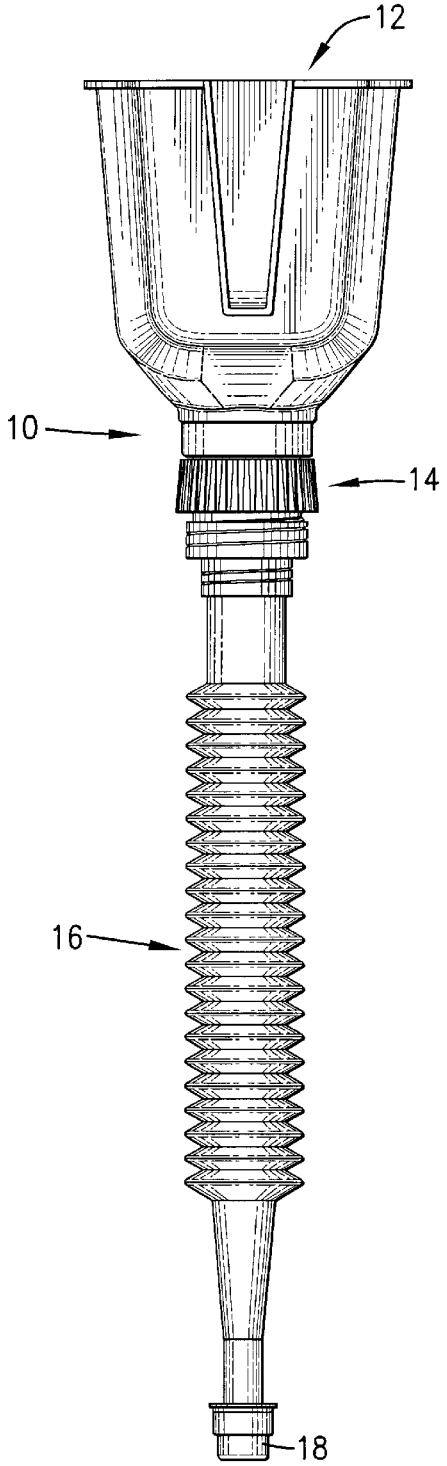
FIG. 4 is a rear elevational view of the pouring system of FIG. 3.
Figure 5:
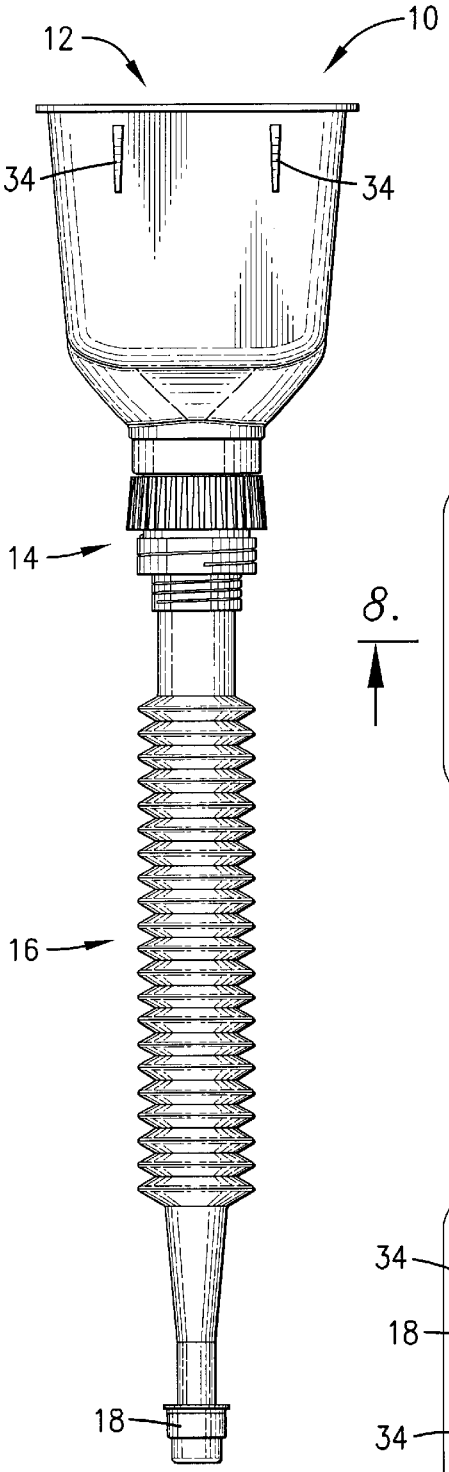
FIG. 5 is a front elevational view of the pouring system of FIG. 3.
Figure 6:
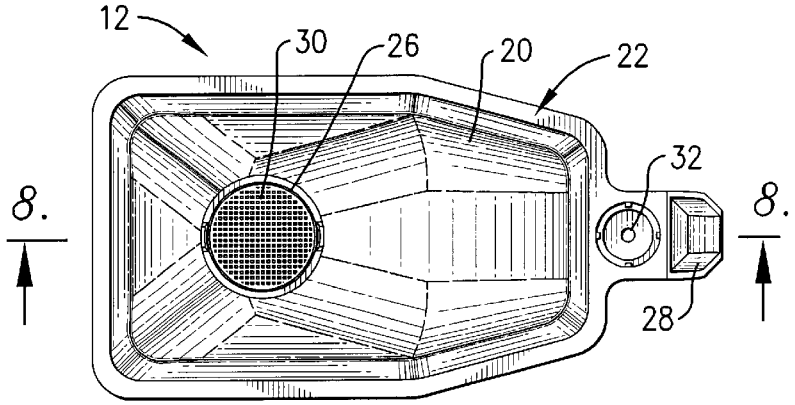
FIG. 6 is a top plan view of the pouring system of FIG. 3.
Figure 7:
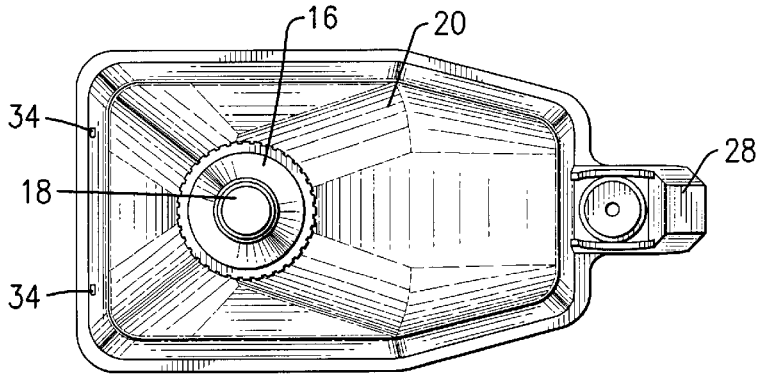
FIG. 7 is a bottom plan view of the pouring system of FIG. 3.
Figure 8:
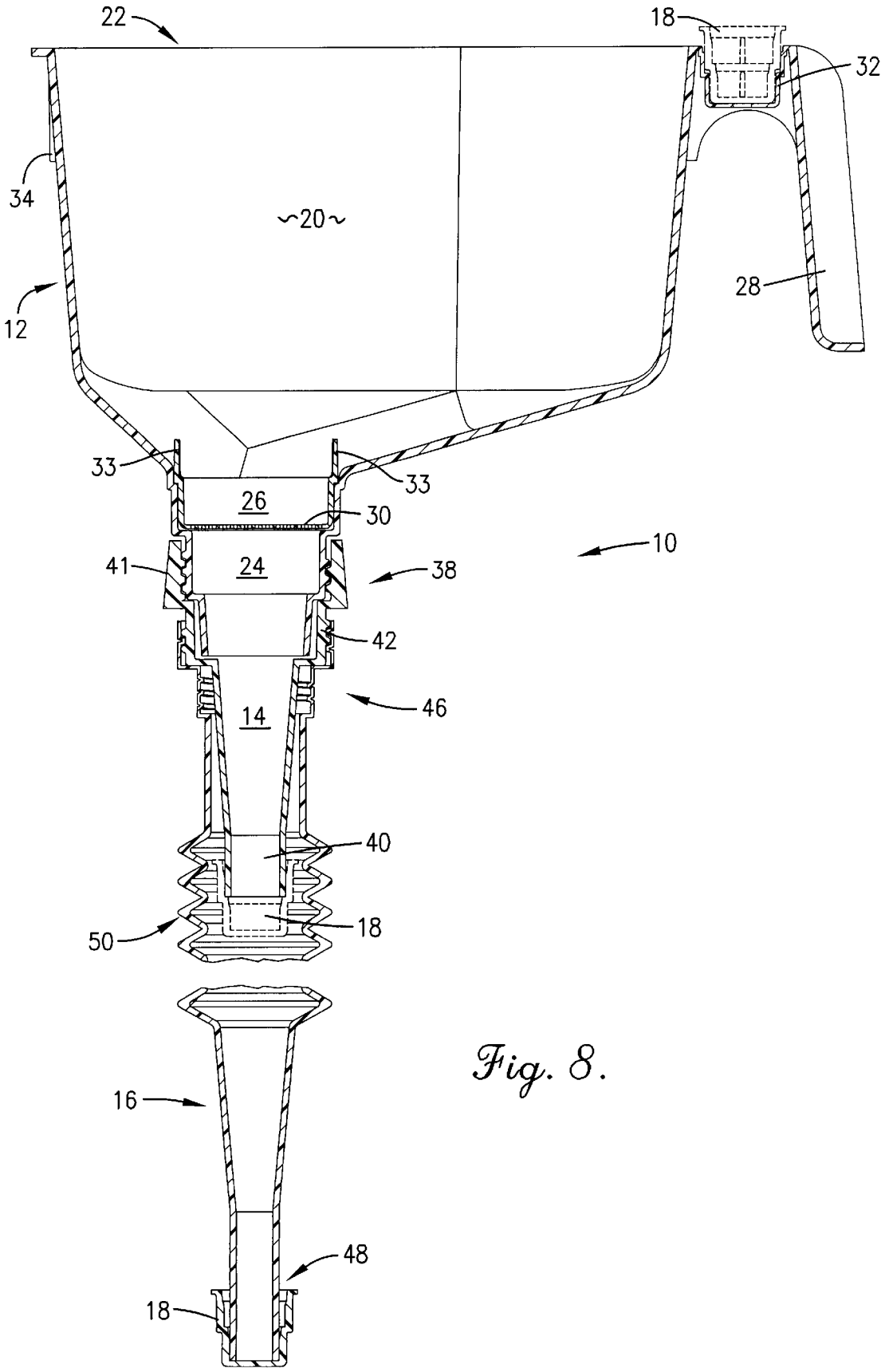
FIG. 8 is a fragmentary right side sectional view taken along line 8—8 of FIG. 6, with alternative cap placements shown in broken line to facilitate understanding.

Referring to FIGS. 1 and 8, a versatile pouring system 10 is shown constructed in accordance with a preferred embodiment of the present invention, and operable to provide a simple and inexpensive combination device reducible to constituent components having increased functionality whether used independently, in subcombinations, or as an aggregate whole. The pouring system 10 broadly comprises constituent components including a funnel 12, having a removable filter 26; a short spout 14; a long spout 16; and a cap 18. All such components are preferably made of high impact, durable plastic or other suitable lightweight and fluid-resistant material.

The funnel 12 provides a mechanism whereby a flow of liquid can be focused and directed into a desired flowpath to avoid spillage. The funnel 12 includes a bowl 20, having an open mouth 22; a neck 24; the removable filter 26; and a handle 28. The bowl 20 is semi-rectangular in shape, being operable to accommodate and support a one quart substantially rectangular container, such as a common oil or transmission fluid container. The bowl 20 is of sufficient depth to hold at least one quart of otherwise uncontained fluid, or to securely support and retain the one quart container. The interior surfaces of the bowl 20 are smooth and unobstructed so as to enhance the flow and drainage of liquid and facilitate cleaning. The sides of the bowl 20 taper by varying degrees, being widest at the mouth 22, then tapering only slightly for approximately 60%–80% of its depth, then tapering sharply over its remaining depth to its narrowest point where it joins the neck 24.

The mouth 22 is a semi-rectangular opening in the bowl 20 suitable to receive the aforementioned fluid containers. The neck 24 is a tapering tubular extension depending from the bowl 20 and ending in a circular opening of substantially less area than the mouth 22. The neck 24, rather than being centered at the bottom of the bowl 20, is offset 10–30% from center in order to accommodate fluid containers of similar offset or asymmetrical shape. The neck 24 is externally threaded so as to couple with the short or long spouts 14,16.

The removable filter 26 is operable to trap debris or other foreign material and prevent such from entering the neck 24. The filter 26 is preferably cylindric, though it may be any suitable shape, with a plastic mesh 30 covering the bottom of the cylinder. The filter 26 is snugly received within the neck 24 so as to be reliably retained in an operative position. Tabs 33 rise uprightly into the bowl 20 from the sides of the filter 26 to facilitate gripping and removing the filter 26 from the funnel 12 for cleaning. Because the filter 26, being cylindric, has depth and sidewalls, any debris trapped by the mesh 30 is retained rather than dropped into the bowl 20 or lost down the neck 24 when the filter 26 is removed.

The handle 28 is a molded extension of the bowl 20 providing a convenient gripping structure. A recess 32 is manufactured into a top portion of the handle 28, with the recess 32 being sized and suitable to receive and conveniently retain the cap 18 securely in an upright position, thereby preventing spillage of any fluid or residue present in the cap 18.

Ribs 34 are manufactured into one or more exterior sides of the funnel bowl 20 to facilitate production nesting and shifting. That is, the ribs 34 allow for stable stacking and nesting of multiple funnels 12 within one another.

The short spout 14 is operable to focus and direct a flow of liquid. The short spout 14 includes first and second ends 38,40. The first end 38 presents a circular opening and is internally threaded to couple with the threaded funnel neck 24 or the threaded opening of a commonly available large-mouthed fluid container, such as a one gallon antifreeze jug or an emergency fuel container. The first end 38 includes a knurled portion 41 to aid gripping and turning. Between the first and second ends 38,40 is an intermediate externally threaded portion 42 corresponding to and coupleable with the long spout 16, as is described below. The second end 40 is also circularly open but tapers to a smaller diameter than the first end 38 so as to focus a flow of liquid, and so that the second end 40 may be received within the long spout 16 when the system 10 is assembled. As noted, the short spout 14 may be used in conjunction with the funnel 12, being threadably coupled to the neck 24 to depend therefrom, or independently, being threadably coupled to a large-mouthed container opening.

The long spout 16 is operable to focus and direct a flow of liquid for a longer length than the short spout 14. The long spout 16 includes first and second ends 46,48. The first end 46 presents a circular opening and is internally doubly threaded to couple with the intermediate externally threaded portion 42 of the short spout 14, a commonly available large-mouthed fluid container, and a small-mouthed one-quart container, such as an oil or transmission fluid container. An intermediate portion 50 of the long spout 16 is ribbed so as to be flexible and allow a substantial degree of bending. The second end 48 is also circularly open but tapers to a smaller diameter than the first end 46 so as to focus a flow of liquid. As noted, the long spout 16 may be used in conjunction with the short spout 14 and funnel 12, being threadably coupled to depend therefrom, or independently, being threadably coupled to a large- or small-mouthed container opening.

The cap 18 fits snugly onto the second openings 38,48 of both the short and long spouts 14,16 to prevent liquid loss therefrom. The cap also fits snugly in an upright orientation into the retaining recess 32 manufactured into the funnel handle 28.

In operation, assuming the system 10 is initially completely assembled, as is shown in FIGS. 2–7, a mechanic, for example, desiring to add fluid to a vehicular system may choose to use the combined system 10 to do so. Up to one quart of liquid may be poured into the funnel bowl 20, or the entire fluid container placed therein, then the long spout 16 positioned to deliver the fluid where needed, and the cap 18 removed to allow the fluid to flow. The filter 26 traps any undesirable material and prevents such from entering the vehicle. As the fluid drains, the cap 18 may be placed in the retaining recess 32 of the handle 28 so not to be misplaced. The cap 18 may be replaced on the end of the long spout 16 at any time during or after draining of the fluid. Once the bowl is empty, the filter 26 may be removed, by grasping and pulling upward on the tabs 33, and cleaned. Furthermore, the smooth interior surface of the bowl 20 provides for fast, safe cleanup, as well as enhanced flow and drainage characteristics.

Alternatively, the same procedure may be followed with the long spout 16 removed and the short spout 14 in place on the funnel neck 24, or with both the short and long spouts 14,16 removed, in which latter case the funnel neck 24 alone provides focus and guidance to then liquid flow.

Where the mechanic desires, for example, to add large amounts of antifreeze to the vehicle's radiator, the short spout 14 or long spout 16 may be removed from the funnel 12 and threadably coupled with the large-mouthed threaded antifreeze jug. The bottle may then be tipped and fluid emptied therefrom as desired.

Where the mechanic desires, for example, to add fluid to a reservoir whose opening is difficult to access, the mechanic may remove the long spout 16 from the funnel 12 and couple the spout 16 with either a large- or small-mouthed fluid container. This is made possible by the double-sized internal threading at the first end 46 of the long spout 16. As may be necessary, the spout 16 may be flexed or bent, which is made possible by the spout's ribbed construction 50, to reach the reservoir access opening, From the preceding description, it can be seen that the pouring system 10 of the present invention provides a simple and inexpensive combination device reducible to constituent components having increased functionality whether used independently, in sub-combinations, or as an aggregate whole. Although the invention has been described with reference to the preferred embodiment illustrated in the attached drawings, it is noted that equivalents may be employed and substitutions made herein without departing from the scope of the invention as recited in the claims. For example, the spouts 14,16 are independent of any specific lengths, which may vary depending upon design and contemplated application, the only requirement being that one is longer than the other so as to preserve system versatility.

Having thus described the preferred embodiment of the invention, what is claimed as new and desired to be protected by Letters Patent includes the following:

1. A pouring system for directing a flow of liquid, the pouring system comprising:

a funnel including a semi-rectangular bowl having a semi-rectangular mouth and a smooth interior surface, a threaded neck depending from the bowl, a filter removably insertable into an upper portion of the threaded neck and having upstanding graspable tabs, and a handle projecting from the bowl and having a cap-retaining recess;

a first sprout having a first length and operable to couple with the threaded neck;

a second spout having a second length and operable to couple with the first spout; and a cap operable to fit the first spout and the second spout and to be received within the cap-retaining recess.

2. The pouring system as set forth in claim 1, wherein the bowl encloses a volume of space substantially equal to one quart.

3. The pouring system as set forth in claim 1, wherein the neck, in depending from the bowl, is offset rather than centered.

4. The pouring system as set forth in claim 1, further including a nesting rib projecting from an exterior surface of the bowl.

5. The pouring system as set forth in claim 1, wherein the first spout is shorter than the second spout and the first spout is operable to substantially fit inside the second spout.

6. The pouring system as set forth in claim 1, wherein the first spout is operable to couple with a large-mouthed container.

7. The pouring system as set forth in claim 1, wherein the first spout includes a knurled portion operable to facilitate gripping and turning.

8. The pouring system as set forth in claim 1, wherein the second spout is operable to couple with both a wide-mouthed container and a smaller-mouthed container.

9. The pouring system as set forth in claim 1, wherein the second spout is flexible along a substantial portion of its length.

* * * * *